US007546920B1

(12) United States Patent
Horn et al.

(10) Patent No.: US 7,546,920 B1
(45) Date of Patent: Jun. 16, 2009

(54) RIFLE TRAVEL CASE

(75) Inventors: William A. Horn, Chino Hills, CA (US); Aaron M. Baker, Claremont, CA (US)

(73) Assignee: Cannon Safe Inc., San Bernardio, CA (US)

( * ) Notice: Subject to any disclaimer, the term of this patent is extended or adjusted under 35 U.S.C. 154(b) by 267 days.

(21) Appl. No.: 11/526,262

(22) Filed: Sep. 25, 2006

(51) Int. Cl.
*B65D 85/00* (2006.01)
*B65D 55/14* (2006.01)

(52) U.S. Cl. ..... 206/317; 70/63

(58) Field of Classification Search ..... 206/317, 206/315.11, 523, 579, 501, 314, 372, 373, 206/3; 70/63, 285, 279; 42/70.11; 109/45; 190/120, 101, 59, 40, 412, 53, 57; 340/825.31; 220/521, 4.26
See application file for complete search history.

(56) References Cited

U.S. PATENT DOCUMENTS 3,811,562 A * 5/1974 Smith ..... 206/317
5,161,396 A * 11/1992 Loeff ..... 70/63
D336,984 S 7/1993 VanSkiver
D358,255 S 5/1995 Sharp et al.
5,645,383 A * 7/1997 Williams ..... 411/43
5,678,686 A 10/1997 Hagemann et al.
5,881,874 A * 3/1999 McKinney ..... 206/315.11
6,009,996 A 1/2000 Purdy
D448,662 S 10/2001 Kopin
6,601,680 B2 * 8/2003 Japchen ..... 190/120
6,736,265 B2 * 5/2004 Kipper et al. ..... 206/373
6,843,081 B1 * 1/2005 Painter ..... 70/63
6,845,640 B2 1/2005 Loeff et al.
6,874,628 B2 4/2005 Hammill

* cited by examiner

*Primary Examiner*—Bryon P Gehman
*Assistant Examiner*—Ernesto A Grano
(74) *Attorney, Agent, or Firm*—Gordon K. Anderson

(57) ABSTRACT

A firearm aluminum travel case (10) for protecting rifles during transportation consist of a rectangular lower enclosure body (20) and a rectangular upper enclosure body (34) arcuately attached together with a continuous hinge (52) along longitudinal sides. Cushions (48) and (50) are incorporated into each body respectively for retaining at least one rifle securely during transit. A resilient gasket (56) forms a seal between the lower and upper enclosure body also recessed tilt casters (62) and a handle (64) are provided for manual towing. An electrical two point locking system is housed within the enclosure bodies and includes a touch pad (70) incorporating an electronic controller (62) that electrically operates the locking system. A mechanical bypass panel cam lock (104) circumvents the electrical two point locking system providing access assurance.

14 Claims, 8 Drawing Sheets

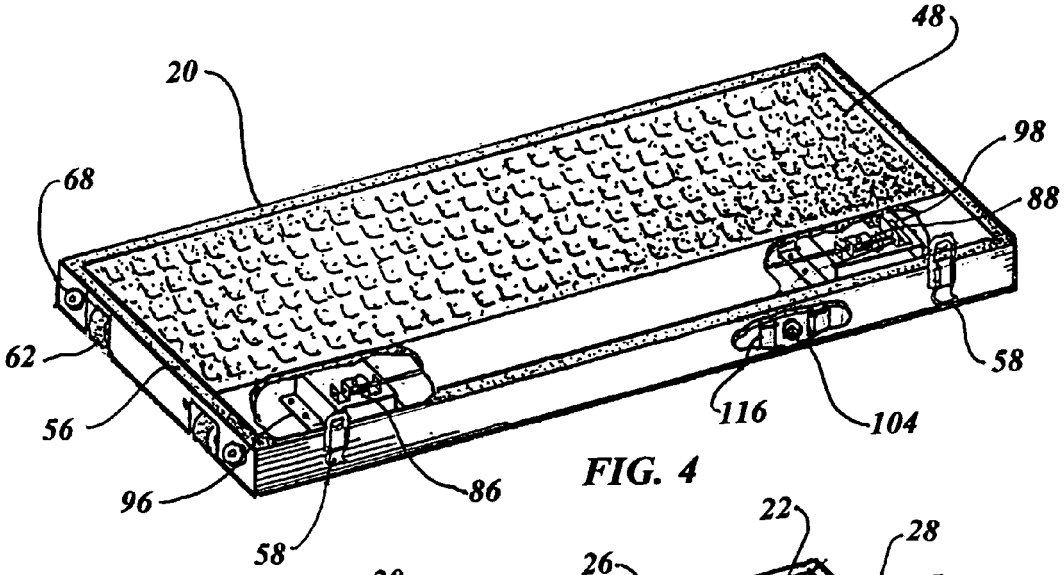
FIG. 4
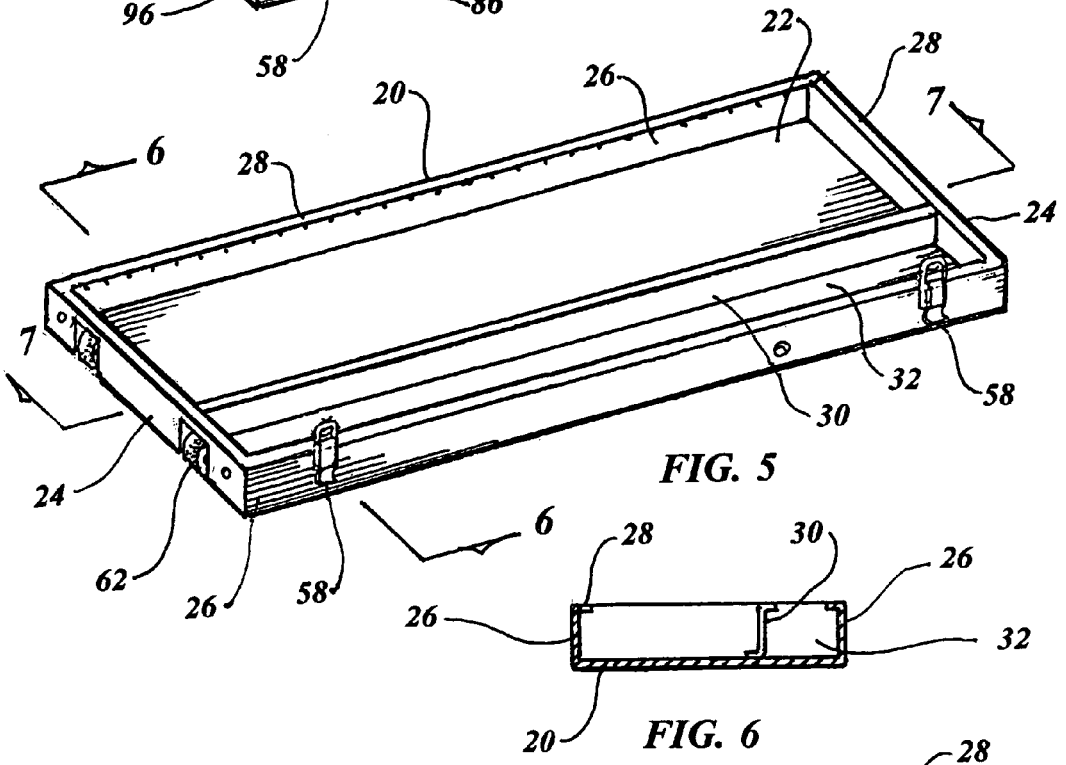
FIG. 5
FIG. 6
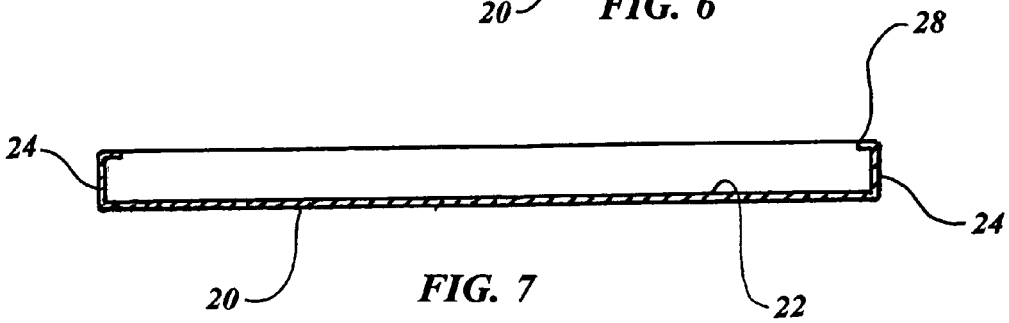
FIG. 7

RIFLE TRAVEL CASE

TECHNICAL FIELD

The present invention relates to rigid metallic firearm cases in general. More specifically to aluminum firearm travel case having electrical two point means for locking with a mechanical bypass lock.

BACKGROUND ART

Previously, many types of gun cases have been used in endeavoring to provide an effective means to transport a firearm in a safe and secure manner with conventional draw pull latches for closure.

The prior art listed below did not disclose patents that possess any of the novelty of the instant invention; however the following U.S. patents are considered related:

| Pat. No. | Inventor | Issue Date |
|---|---|---|
| Des. 336,984 | VanSkiver | Jul. 6, 1993 |
| Des. 358,255 | Sharp et al. | May 16, 1995 |
| 5,678,686 | Hagemann et al. | Oct. 21, 1997 |
| 6,009,996 | Purdy | Jan. 4, 2000 |
| D448,662 S | Kopin | Oct. 2, 2001 |
| 6,845,640 B2 | Loeff et al. | Jan. 25, 2005 |
| 6,874,628 B2 | Hammill | Apr. 5, 2005 |

Hagemann et al. in U.S. Pat. No. 5,678,686 teaches a gun case having rigid walls for storing a gun vertically. The case includes an upper case portion mating with a lower case portion and resilient cradles for supporting the gun. At least one lockable strap is provided for securing the gun to the lower case portion.

U.S. Pat. No. 6,009,996 issued to Purdy is for a carrying case for a dissembled shotgun. The case consists of an outer case member with portions hinged together defining a compartment. An insert member is mounted within and extends from one member to the other for insertion of the barrel subassembly and the stock subassembly.

Loeff et al. in U.S. Pat. No. 6,845,640 B2 discloses a quick release long gun case which enclosed the action of the gun. A programmed keypad allows access to the gun and a key operated override mechanism is provided. The actuating mechanisms provided utilize a motor with a cable windable around a shaft and a actuator rotated when a proper key is received within the keyhole.

Hammill in U.S. Pat. No. 6,874,628 B2 teaches a retainer for holding a gun in a rigid case. The case contains a low stiffness cushion with the gun engaging the material when stored. A pair of straps extends tightly around the gun compressing it into the material.

For background purposes and as indicative of the art to which the invention is related reference may be made to the following Design patents; Des. 336,984 issued to VanSkiver, Des. 358,255 issued to Sharp et al. and D448,662 S issued to Kopin.

DISCLOSURE OF THE INVENTION

In the past many different types of cases have been in use to protect firearms during transportation. Soft cases are the most popular as they are inexpensive however thermoplastic hard cases provide better protection and use thick cushions which completely isolate the gun or guns. With the rough handling and automatic luggage systems of the airline industry regulations were necessary which eliminated the use of soft cases and mandated hard cases. As some firearms that are used for hunting may be expensive and hard to replace in remote locations it has been found that aluminum construction is the ideal answer to solve the problem for transportation on airlines.

It is therefore a primary object of the invention to utilize a case made of metal in the form of aluminum for strength and also to provide convenient internal locking system without the necessity of always having a key available. While aluminum construction is well known and in common usage the problem of locking is of prime importance as conventional locks and hasps are easily knocked off and conventional keyed hasps are easily breached. In addition to the aluminum construction the invention utilizes an electrical two point locking system that is actuated by a touch pad with an integral solid state controller incorporating an electronic board having push switches on the finger pad, with the controller programmable for up to three user access codes and an audio low-battery warning system. The two point locking system is completely enclosed within the case and incorporates a push-to-close latch and a push-to-close actuator with an actuator extension rod therebetween releasing the electrical two point locking system when an operator has provided the appropriate access code to the keypad.

An important object of the invention is the addition of a mechanical bypass system to override the touch pad which consists of a high security, circular keyway panel lock retained with a key lock bracket within a side of the lower enclosure body. In the event that the user has forgotten the code or the battery for the internal circuitry is completely drained of power or disabled in any way, the case may be opened with the key.

Still another object of the invention is in the inclusion of heavy duty recessed tilt casters imbedded into the bottom and end of the lower body and a handle attached to the upper body end allowing manual towing capabilities when the case is tilted on the casters. There are also recessed bumpers attached to at appropriate locations for resting the case on its side and end without damage.

Yet another object of the invention is realized when using aluminum as the basic material with welded corners and internal flanges which makes the case strong and sturdy also compartments with longitudinal dividers add to the strength and compressibility of the case. The basic sheet aluminum is thicker that most rifle cases that are commonly available on the present market since the invention uses 0.080 inches (0.203 cm) thick basic material and employs a strong robust continuous hinge.

A further object of the invention is in the fact that the invention uses two draw pull latches on the sides that compress the gasket on the inner flanges creating a tight seal between the upper and lower enclosure bodies.

A final object of the invention is in the convenience of the pull handles since they incorporate cushion grips locking in place at 90 degrees and are spring loaded to fit flat against the side or end of the case when not in use.

These and other objects and advantages of the present invention will become apparent from the subsequent detailed description of the preferred embodiment and the is appended claims taken in conjunction with the accompanying drawings.

BRIEF DESCRIPTION OF THE DRAWINGS

FIG. 4 is a partial isometric view of the complete lower enclosure body of the firearm aluminum travel case shown detached from the hinge and completely removed from the invention for clarity.

FIG. 5 is a partial isometric view of only the lower enclosure body of the firearm aluminum travel case completely removed from the invention for clarity.

FIG. 6 is a cross sectional view taken along lines 6-6 of FIG. 5.

FIG. 7 is a cross sectional view taken along lines 7-7 of FIG. 5.

BEST MODE FOR CARRYING OUT THE INVENTION

Figure 1:
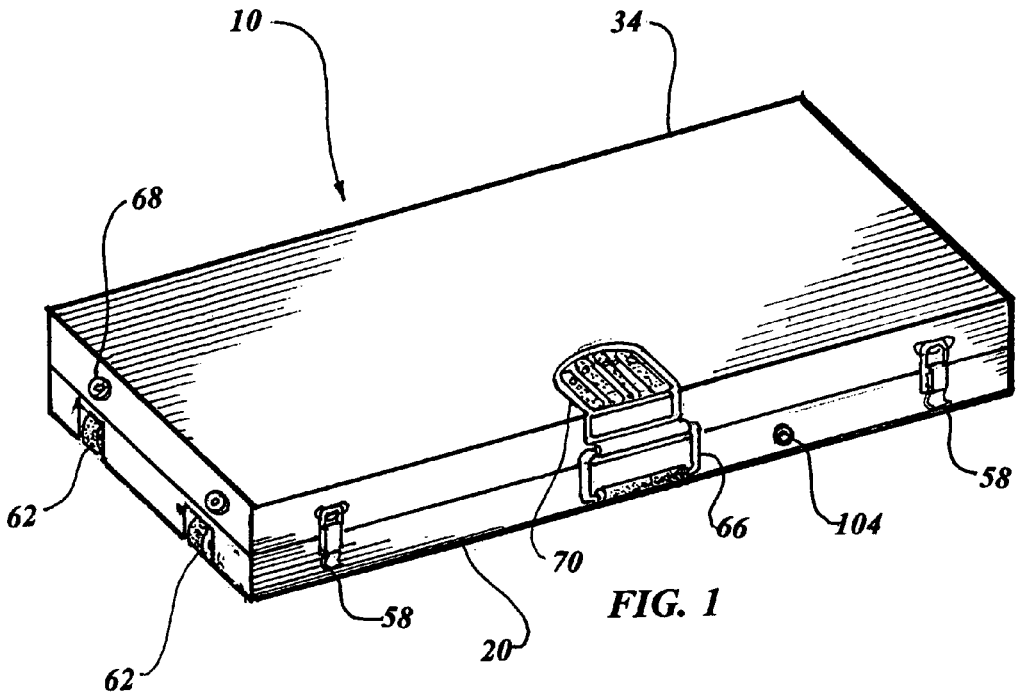
FIG. 1 is a partial isometric view of the front of the firearm aluminum travel case in the preferred embodiment.

The best mode for carrying out the invention is presented in terms of a preferred embodiment of the aluminum travel case 10. This preferred embodiment of the case 10 is shown detailed in FIGS. 1 thorough 38 and viewed in a closed position from the outside in FIGS. 1 and 2 with FIG. 3 illustrating the case 10 opened completely flat. The travel case 10 utilizes a rectangular lower enclosure body 20 which includes a bottom 22, ends 24 and sides 26 with an inwardly facing peripheral flange 28 completely around the ends 24 and sides 26. The lower enclosure body 20 is shown by itself in FIGS. 5-7 and is configured to retain at least one rifle for transportation. The lower enclosure body 20 incorporates a first compartment internal divider 30 that is attached to the lower enclosure body bottom 22 forming a latching system compartment 32, as illustrated in FIGS. 5 and 6.

Figure 26:
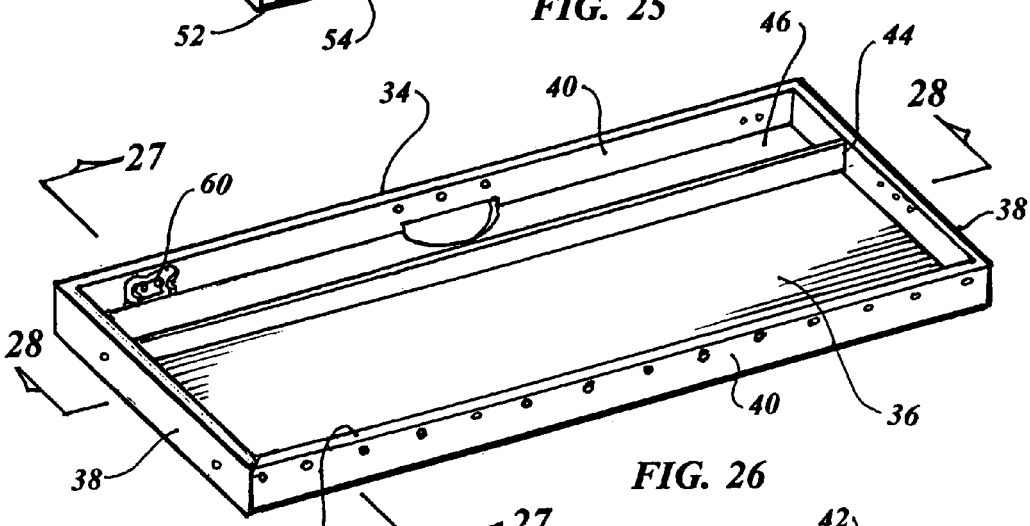
FIG. 26 is a partial isometric view of the upper enclosure body only of the firearm aluminum travel case that has been completely removed from the invention for clarity.
Figure 27:
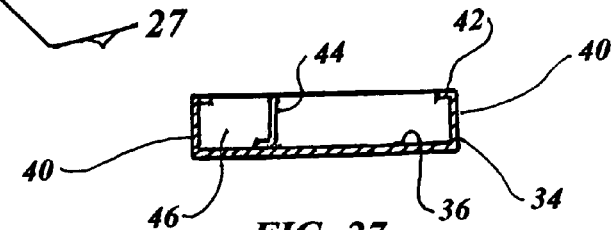
FIG. 27 is a cross sectional view taken along lines 27-27 of FIG. 26.
Figure 28:
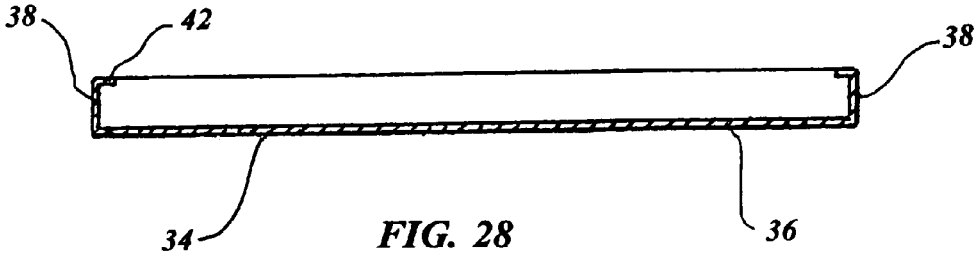
FIG. 28 is a cross sectional view taken along lines 28-28 of FIG. 26.
Figure 29:
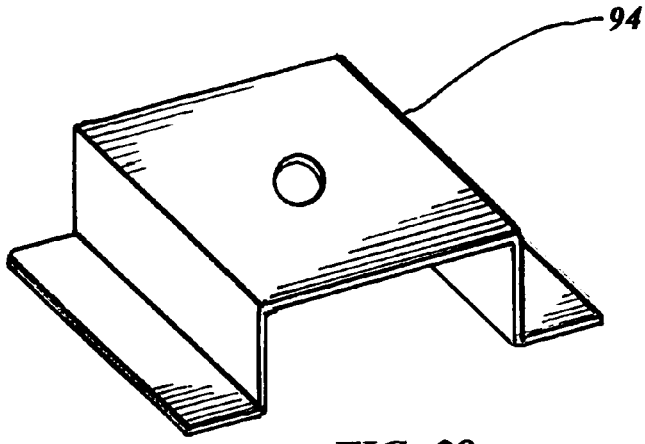
FIG. 29 is a partial isometric view of one of the keeper brackets completely removed from the invention for clarity.
Figure 30:
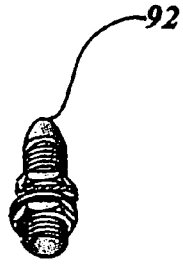
FIG. 30 is a partial isometric view of one of the keeper studs completely removed from the invention for clarity.

A similar rectangular upper enclosure body 34 includes a top 36, ends 38 and sides 40 with an inwardly facing peripheral flange 42 around the ends 38 and sides 40. The upper enclosure body 34 is shown by itself in FIGS. 26-28 and is likewise configured to retain at least one rifle for transportation. The upper enclosure body 34 incorporates a second compartment internal divider 44 that is attached to the body top 36 forming a keeper and touch pad compartment 46.

The lower enclosure body 20 and upper enclosure body 34, with the exception of the dividers 30 and 44, are formed of an aluminum construction having a thickness of at least 0.080 inches (0.203 cm) with welded corners.

Figure 20:
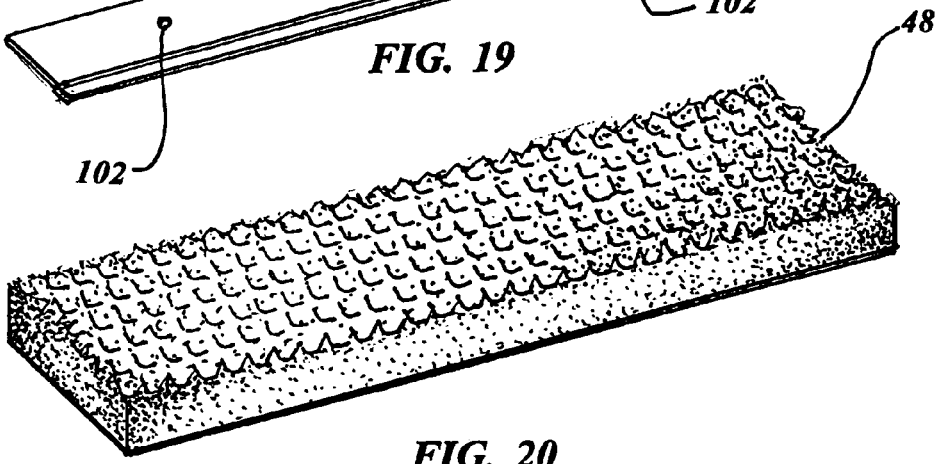
FIG. 20 is a partial isometric view of the lower enclosure body cushion completely removed from the invention for clarity.
Figure 25:
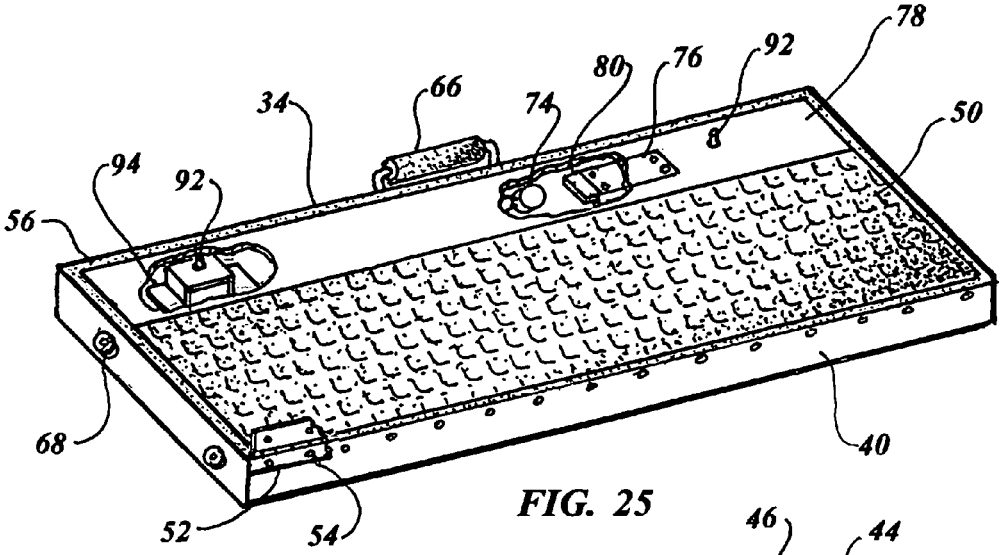
FIG. 25 is a partial isometric view of the complete upper enclosure body of the firearm aluminum travel case shown detached from the lower enclosure body with the hinge partially cut away for clarity.
Figure 37:
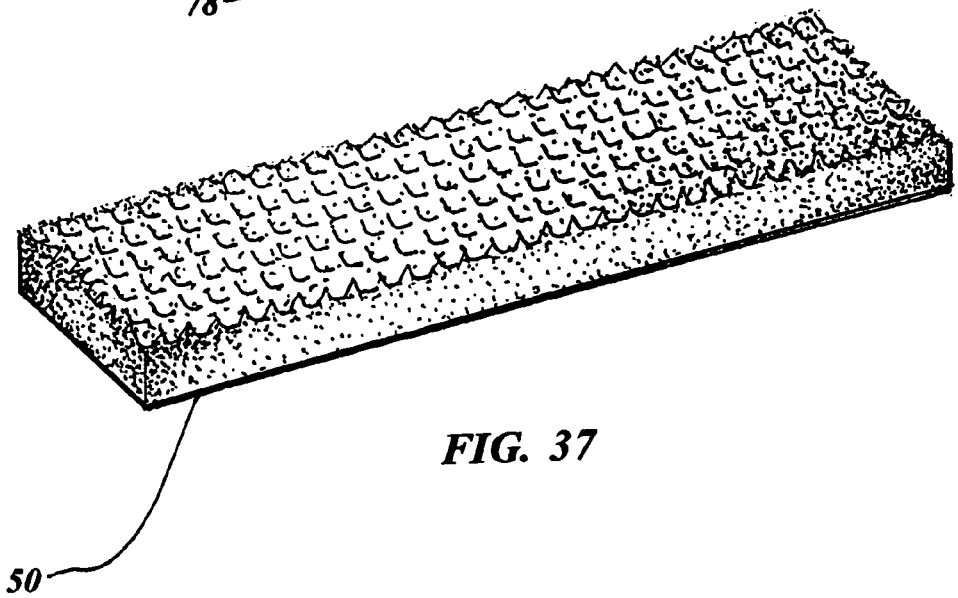
FIG. 37 is a partial isometric view of the upper enclosure body cushion completely removed from the invention for clarity.

The lower enclosure body 20 contains a lower cushion 48, as shown in FIGS. 3 and 4 also by itself in FIG. 20, which is preferably made of closed cell urethane foam in an egg crate style. The upper enclosure body 34 also contains a similar upper cushion 50, as shown in FIGS. 3 and 25 also by itself in FIG. 37, made of the same material. The lower and upper cushion 48 and 50 face each other when the case 10 is closed forming a resilient pad retaining at least one rifle when compressed together.

It will be noted that the case 10 preferably is configured to enclose double rifles it is anticipated that a single rifle or more than two may be stored by simply expanding or contracting the overall size requirements. Any other type of gun such as pistols, revolvers or other delicate items may be transported in the travel case with equal ease and dispatch with the appropriate dimensional configuration.

Figure 2:
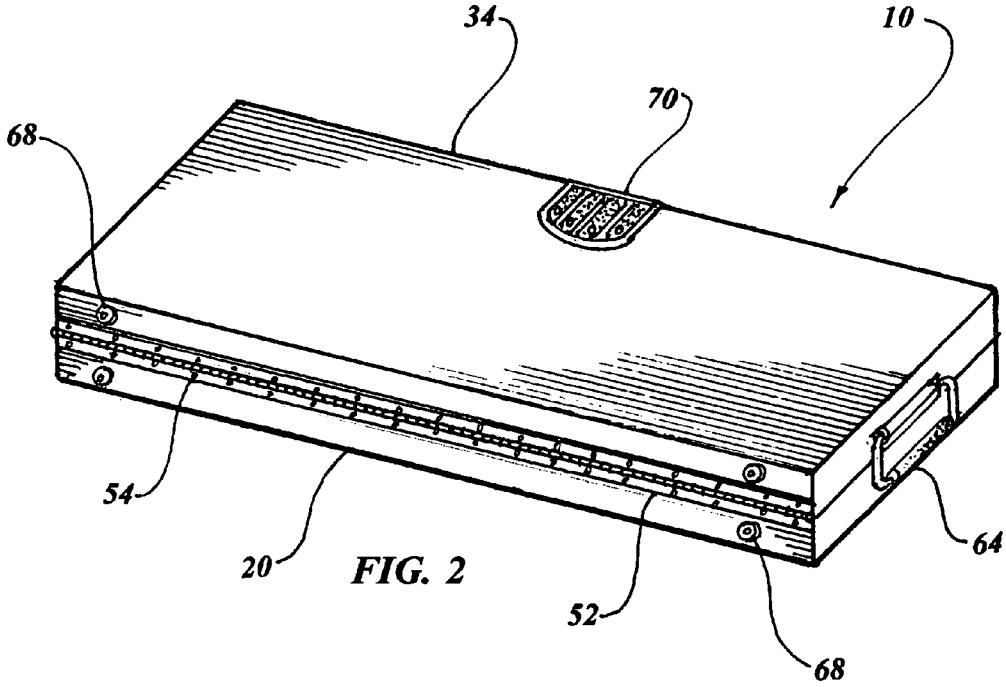
FIG. 2 is a partial isometric rear view of the firearm aluminum travel case in the preferred embodiment.
Figure 3:
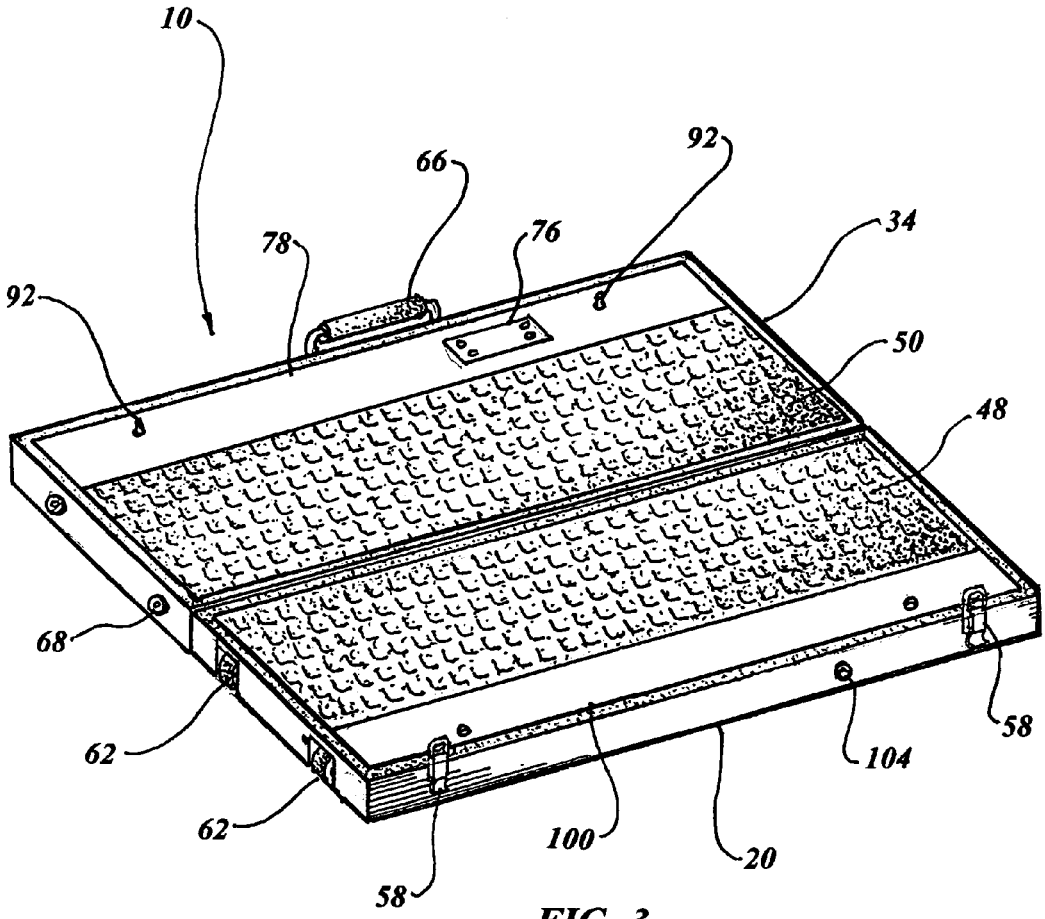
FIG. 3 is a partial isometric view of the firearm aluminum travel case opened flat in its preferred embodiment.

A continuous hinge 52 attaches the lower enclosure body 20 to the upper enclosure body 34 along mating sides 26 and 40, as illustrated in FIG. 2. The continuous hinge 52 includes a pair of opposed aluminum leaves with a stainless steel pin therebetween with the hinge 52 attached to both the lower enclosure body 20 and upper enclosure body 34 preferably with a plurality of closed end rivets 54.

A resilient gasket 56 is adhered to the lower enclosure body peripheral flange 28 forming a seal between the lower enclosure body and the peripheral flange 42 of the upper enclosure body 34. The resilient gasket 56 is preferably a closed cell sponge tape with pressure sensitive adhesive on one side. A pair of draw pull latches 58 are attached to the front side 26 of the lower enclosure body and mating strikers 60 are affixed to the upper enclosure body front side 40 permitting the resilient gasket 56 to be completely compressed therebetween creating an effective seal. FIGS. 3, 4 and 25 illustrate the gasket 56 with the latch 58 and the striker 60 shown in FIGS. 1, 3, 4 and 23.

Figure 21:
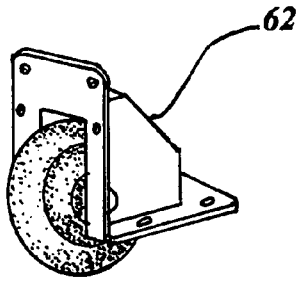
FIG. 21 is a partial isometric view of the recessed tilt caster completely removed from the invention for clarity.

A plurality of recessed tilt casters 62, preferably two, are imbedded into the lower enclosure body 20 within the bottom 22 and an end 24, as depicted in FIGS. 1 and 3-5, and are used for manual case towing. Each recessed tilt caster 62 consist of a plated steel bracket with in-line skate-type polyurethane wheels molded on a polyolefin hub, as illustrated singularly in FIG. 21. In order to have manual towing capabilities when the case is tilted upon the casters 62, a first handle 64 with a 90 degree stop and a return spring is attached to the lower body end 24 opposite the casters 62. The first handle 64 includes a stainless steel return spring and a cushion synthetic rubber grip.

Figure 22:
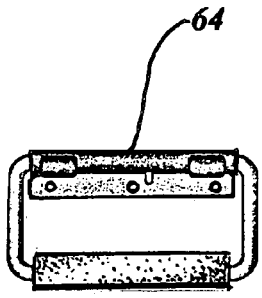
FIG. 22 is a partial isometric view of a first handle completely removed from the invention for clarity.
Figure 23:
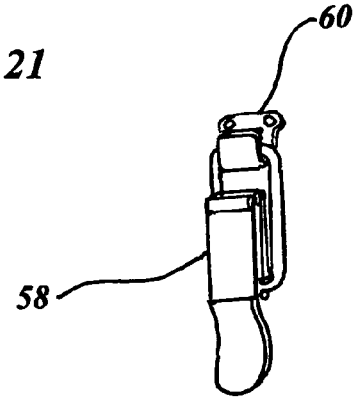
FIG. 23 is a partial isometric view of one of the draw pull latches completely removed from the invention for clarity.
Figure 24:
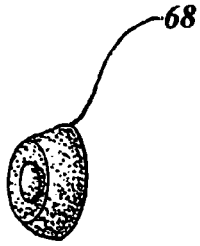
FIG. 24 is a partial isometric view of one of the recessed bumpers used on the upper enclosure body completely removed from the invention for clarity.
Figure 38:
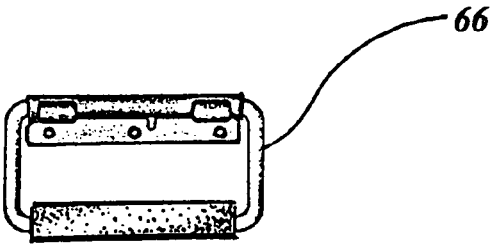
FIG. 38 is a partial isometric view of the second draw pull latch completely removed from the invention for clarity.

For convenience, the firearm travel case 10 includes a second handle 66, also with 90 degree stop, a stainless steel return spring and a cushion synthetic rubber grip, attached to an upper body side 40 for carrying the case horizontally. The first handle 64 is shown unattached in FIG. 22 and the second handle by itself in FIG. 38. A plurality of recessed bumpers 68, illustrated installed in FIGS. 1-4 and unattached in FIG. 24, are utilized for resting the case 10 on its side or end without damage.

Figure 10:
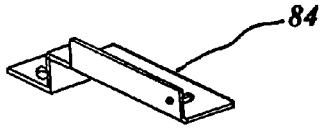
FIG. 10 is a partial isometric view of the latch actuating arm completely removed from the invention for clarity.
Figure 11:
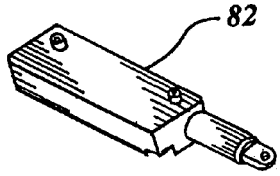
FIG. 11 is a partial isometric view of the power lock actuator completely removed from the invention for clarity.
Figure 12:
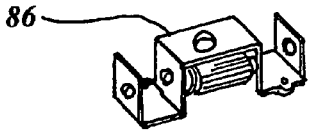
FIG. 12 is a partial isometric view of the push-to-close latch completely removed from the invention for clarity.
Figure 13:
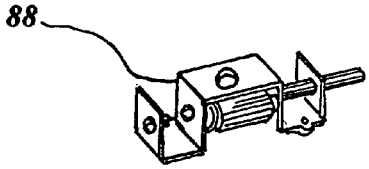
FIG. 13 is a partial isometric view of the push-to-close actuator completely removed from the invention for clarity.
Figure 18:
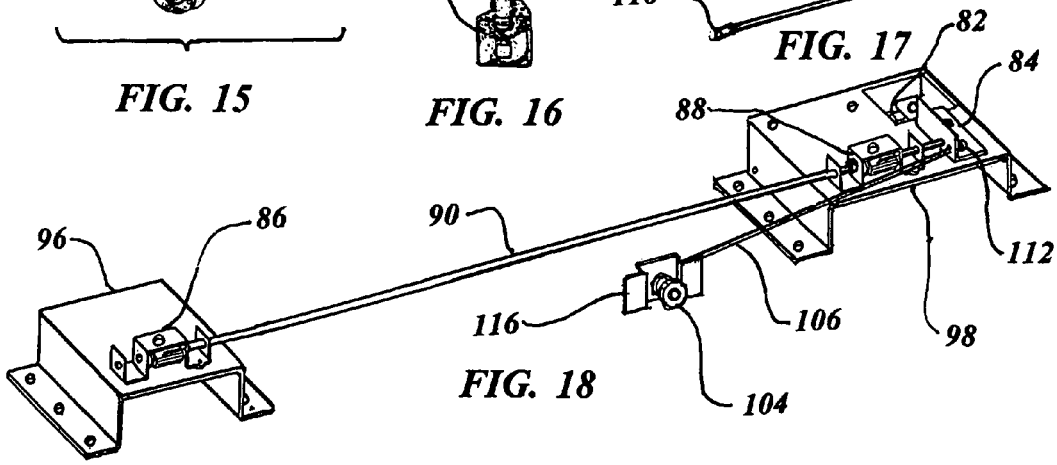
FIG. 18 is a partial isometric view of the push-to-close locking system and bypass lock including the brackets with the system completely removed from the invention for clarity.
Figure 19:
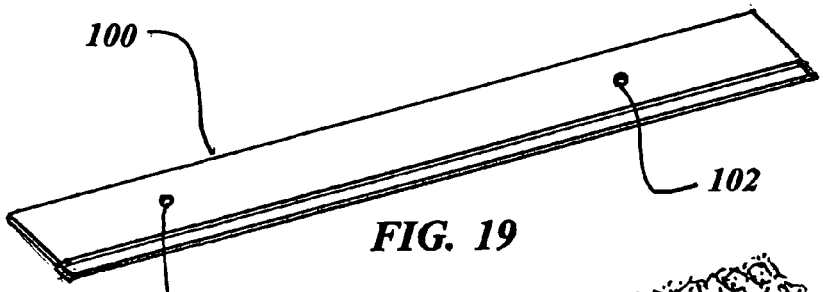
FIG. 19 is a partial isometric view of the latching system cover completely removed from the invention for clarity.
Figure 31:
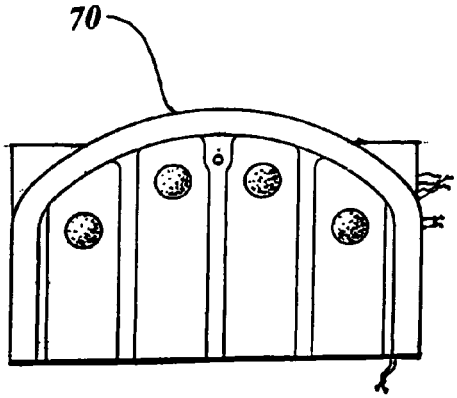
FIG. 31 is a top view of the keypad completely removed from the invention for clarity.
Figure 32:
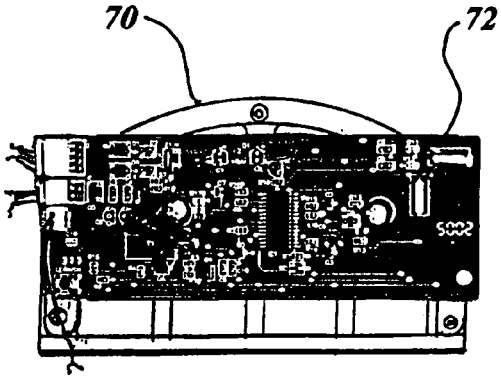
FIG. 32 is a bottom view of the keypad illustrating the integral solid state controller completely removed from the invention for clarity.
Figure 33:
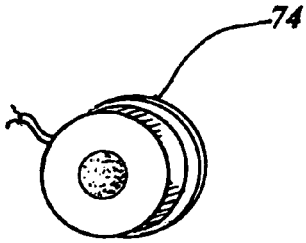
FIG. 33 is a partial isometric view of the enunciator completely removed from the invention for clarity.
Figure 34:
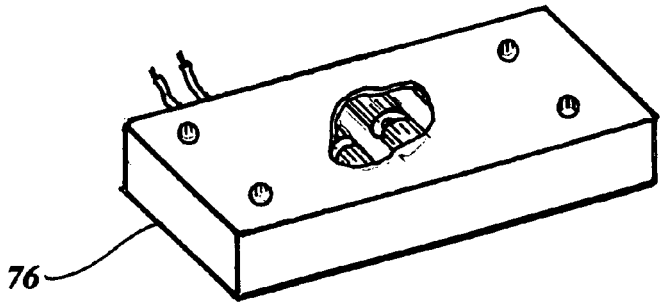
FIG. 34 is a partial isometric view of the battery pack bracket completely removed from the invention for clarity.
Figure 35:
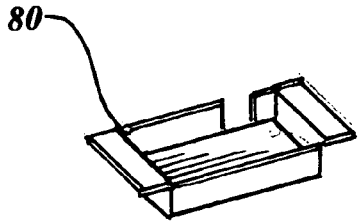
FIG. 35 is a partial isometric view of the battery pack completely removed from the invention for clarity.
Figure 36:
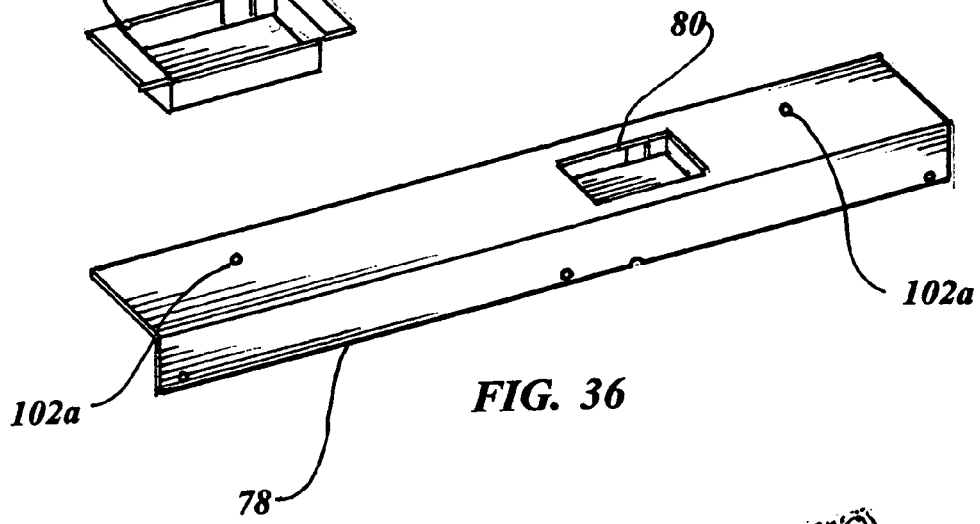
FIG. 36 is a partial isometric view of the latch keeper stud and battery pack cover completely removed from the invention for clarity.

Electrical two point means for locking are housed within the lower enclosure body 20 and the upper enclosure body 34 providing a touch pad electrically operating a push-to-close and button to open latching system. The rifle electrical two point means for locking and accompanying latching system consist of the following:

a) a touch pad 70 having an aluminum, zinc or thermoplastic bezel, a synthetic rubber finger pad and at least one attaching bracket is illustrated by itself in FIGS. 31 and 32 and has been on the market for some time and is commercially successful under the registered trademark GUNVAULT.

b) a solid state controller 72 is integral with the touch pad 70 and incorporates an electronic board having push switches in contact with the finger pad. The controller 72 is programmable for up to three user access codes and includes a audio low-battery warning system.

c) a remote located enunciator 74 is in electrical communication with the controller 72 producing an audio indication signal. The enunciator 74 is illustrated by itself in FIG. 33.

d) a battery pack 76 is housed within a controller and latch keeper cover 78 is in electrical communication with the controller 72. The battery pack 76 is shown alone in FIG. 34 and is held in place with a battery pack bracket 80, depicted in FIG. 35, which is attached to the controller and latch keeper cover 78 illustrated in FIG. 36. the battery pack 67 preferably utilizes eight AA batteries that are readily available and easily replaced.

e) a power lock actuator 82, depicted separately in FIG. 11 and attached in FIG. 18, is positioned within the lower enclosure body latching system compartment 32, and is energized by the solid state controller 72 for releasing the electrical two point means for locking to unlock the case 10.

f) a latch actuating arm 84 attached to the power lock actuator 82 transfers linear movement to the push-to-close and button for opening the latching system and is shown installed on the power lock actuator 82 in FIG. 18 and alone in FIG. 10.

g) a push-to-close latch 86 and a push-to-close actuator 88 with an actuator extension rod 90 therebetween releasing the electrical two point means for locking when an operator has provided an appropriate access code to the keypad, and h) two keeper studs 92 disposed one on each of two keeper brackets 94 which are attached to an inside surface of the upper enclosure top 36 each in alignment with the push-to-close latch 86 and push-to-close actuator 88 for locking the upper enclosure body 34 to the lower enclosure body 20 by manually closing and urged the bodies 20 and 34 together until an interface is achieved.

Figure 8:
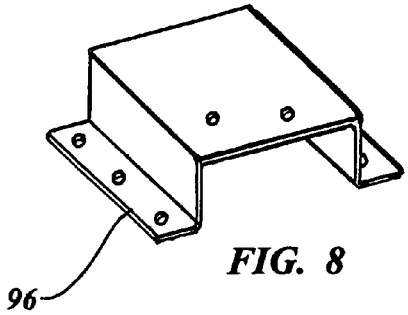
FIG. 8 is a partial isometric view of the latch bracket completely removed from the invention for clarity.
Figure 9:
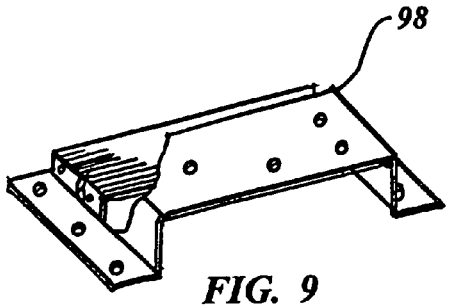
FIG. 9 is a partial isometric view of the actuator bracket completely removed from the invention for clarity.

FIG. 18 illustrates a lower portion of the two point means for locking with the push-to-close latch 86 mounted on a latch bracket 96, illustrated alone in FIG. 8 and the push-to-close actuator 88 mounted on a actuator bracket 98, which is shown by itself in FIG. 9. The extension rod 90 connects the latch 86 and actuator 88 together with the power lock actuator 82 mounted under the actuator bracket 98. The power lock actuator 82 is connected to the latch actuating arm 84 which slides on the top of the actuator bracket 98 and interfaces with an extended button on the push-to-close actuator 88. The entire lower portion of the two point means for, as shown in FIG. 18, is positioned within the latching system compartment 32. The latch bracket 96 along with the actuator bracket 98 are attached directly to the upper surface of the lower enclosure body bottom 22.

The latching system compartment 32 is enclosed with a removable latching system cover 100 and clearance holes 102 are provided over the push-to-close latch 86 and push-to-close actuator 88 which align with the keeper studs 92 penetrating through similar clearance holes 102*a* in the latch keeper cover 78.

In functional operation the case 10 is opened by pressing the appropriate code on the touch pad 70 which energizes the power lock actuator 82 pulling the latch actuating arm 84 into contact with the extended button on the push-to-close actuator 88 releasing each keeper stud 92 from the push-to-close latch 86 and push-to-close actuator 88.

Figure 15:
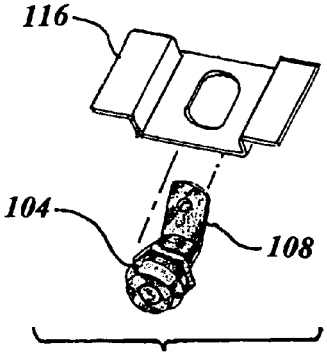
FIG. 15 is an exploded isometric view of the keyed cam lock and the key lock bracket completely removed from the invention for clarity.
Figure 14:
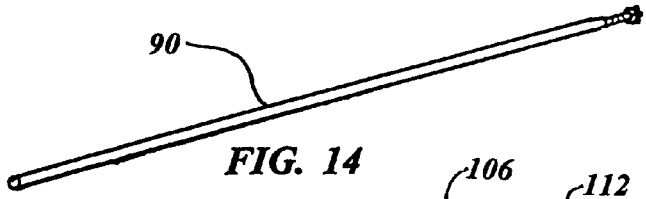
FIG. 14 is a partial isometric view of the push-to-close actuator extension rod completely removed from the invention for clarity.
Figure 16:
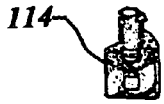
FIG. 16 is a partial isometric view of the key for the keyed cam lock completely removed from the invention for clarity.
Figure 17:
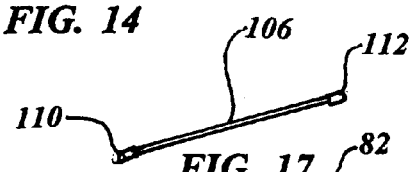
FIG. 17 is a partial isometric view of the lock cable completely removed from the invention for clarity.

The firearm aluminum travel case 10 incorporates a mechanical bypass which circumvents the electrical locking means, described previously, which consists of a keyed panel cam lock 104 with a lock cable 106 attached to a cam arm 108 of the lock 104 on a first end 110 and to the latch actuating arm 84 on a second end 112. When the panel cam lock 104 is manually rotated by an operator with a key 114 the latch actuating arm 84 is mechanically slid into contact with the extended button on the push-to-close actuator 88 overriding the electrical locking means. While any panel cam lock may be used a high security, circular keyway panel lock is preferred. The panel cam lock 104 is retained with a key lock bracket 116 within a side 26 of the lower enclosure body 20, as illustrated in FIGS. 4 and 15

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A firearm aluminum travel case for protecting at least one rifle during transportation which comprises, a travel case rectangular lower enclosure body having a bottom, ends and sides with a inwardly facing peripheral flange around the ends and the sides and a cushion disposed therein, the lower enclosure body configured to retain at least one rifle for transportation, a travel case rectangular upper enclosure body having a top, ends and sides with an inwardly facing peripheral flange around the ends and the sides also a cushion disposed therein, the upper enclosure body configured to retain at least one rifle for transportation, a continuous hinge attaching the lower enclosure body to the upper enclosure body along mating sides, a resilient gasket adhered to the lower enclosure body peripheral flange forming a seal between the lower enclosure body and the upper enclosure body, a plurality of recessed tilt casters imbedded into the lower enclosure body within the bottom and an end for manual case towing, a first handle with a 90 degree stop and a return spring attached to a lower body end allowing manual towing capabilities when the case is tilted upon the casters, an electrical two point means for locking housed within the lower enclosure body and the upper enclosure body defined as a touch pad electrically operating a push-to-close and button to open latching system, a touch pad having an aluminum bezel, a synthetic rubber finger pad and at least one attaching bracket, wherein said electrical two point means for locking further comprises, a solid state controller integral with the touch pad, said controller incorporating in an electronic board having a plurality of push switches intimately embracing the finger pad, with the controller programmable for up to three user access codes and an audio low-battery warning system, a remote located enunciator in electrical communication with the controller for producing an audio indication signal, a battery pack housed within a controller and latch keeper cover in electrical communication with the controller, a power lock actuator positioned within said lower enclosure body, energized by the solid state controller for releasing the electrical two point means for locking to unlock the case, a latch actuating arm attached to the power lock actuator transferring linear movement to the push-to-close and button to open latching system, a push-to-close latch and a push-to-close actuator with an actuator extension rod therebetween releasing the electrical two point means for locking when an operator has provided an appropriate access code to the keypad, and a keeper stud disposed within a keeper bracket attached to an inside surface of the upper enclosure top in alignment with the push-to-close latch and the push-to-close actuator for locking the upper enclosure body with the lower enclosure body when manually closed and urged together until an interface is achieved, and a mechanical bypass lock for circumventing said electrical two point means for locking providing access assurance for opening the case when locked, wherein said mechanical bypass for circumventing said electrical two point locking means further comprises a keyed panel cam lock with a lock cable attached to a cam arm of the lock on a first end and to the latch actuating arm on a second end mechanically sliding the latch actuating arm into contact with the push-to-close actuator when the lock is manually rotated by an operator with a key.

2. The firearm aluminum travel case as recited in claim 1 wherein said rectangular lower enclosure body further comprises a first compartment internal divider attached to the lower body bottom forming a latching system compartment.

3. The firearm aluminum travel case as recited in claim 1 wherein said rectangular upper enclosure body further comprises a second compartment internal divider attached to the upper enclosure body top forming a keeper and touch pad compartment.

4. The firearm aluminum travel case as recited in claim 1 wherein said upper enclosure body cushion and said lower enclosure body cushion further comprises a urethane foam closed cell egg crate style resilient pad.

5. The firearm aluminum travel case as recited in claim 1 case wherein said continuous hinge further comprises a pair of opposed aluminum leaves with a stainless steel pin therebetween and the hinge attached to the upper enclosure body and the lower enclosure body with a plurality of closed end rivets.

6. The firearm aluminum travel case as recited in claim 1 wherein said resilient gasket further comprises a closed cell sponge with pressure sensitive adhesive on one side.

7. The firearm aluminum travel case as recited in claim 1 wherein said plurality of recessed tilt casters each further comprise a plated steel bracket with an in-line skate-type polyurethane wheel molded on a polyolefin hub.

8. The firearm aluminum travel case as recited in claim 1 wherein said handle further comprises a stainless steel return spring and a cushion synthetic rubber grip.

9. The firearm aluminum travel case as recited in claim 1 wherein said keyed cam lock further comprises a high security, circular keyway panel lock retained with a key lock bracket within a side of the lower enclosure body.

10. The firearm aluminum travel case as recited in claim 1 wherein said lower enclosure body and upper enclosure body further comprise essentially an all aluminum construction having a thickness of at least 0.080 inches (0.203 cm) with welded corners.

11. The firearm aluminum travel case as recited in claim 1 further comprising a draw pull latch and striker for compressing the resilient gasket between the lower enclosure body and the upper enclosure body to create a seal therewith.

12. The firearm aluminum travel case as recited in claim 1 further comprising a second handle with 90 degree stop and a stainless steel return spring and a cushion synthetic rubber grip attached to an upper body side for carrying the case horizontally.

13. The firearm aluminum travel case as recited in claim 1 further comprising a plurality of recessed bumpers for resting on the case side and end with out damage to the case.

14. The firearm aluminum travel case as recited in claim 1 is configured to enclose at least two rifles.

* * * * *